US008952851B1

(12) United States Patent
Hsu et al.

(10) Patent No.: US 8,952,851 B1
(45) Date of Patent: Feb. 10, 2015

(54) DIRECT FEED PATCH ANTENNA

(75) Inventors: Morris Hsu, Santa Clara, CA (US); Anuj Dron, San Jose, CA (US); Tzung-I Lee, San Jose, CA (US)

(73) Assignee: Amazon Technologies, Inc., Reno, NV (US)

( * ) Notice: Subject to any disclaimer, the term of this patent is extended or adjusted under 35 U.S.C. 154(b) by 208 days.

(21) Appl. No.: 13/523,508

(22) Filed: Jun. 14, 2012

(51) Int. Cl.
*H01Q 1/38* (2006.01)

(52) U.S. Cl.
USPC ..... 343/700 MS; 343/846

(58) Field of Classification Search
USPC ..... 343/700 MS, 829, 846
See application file for complete search history.

(56) References Cited

U.S. PATENT DOCUMENTS

| | | | | | |
|---|---|---|---|---|---|
| 4,386,357 | A * | 5/1983 | Patton | ..... | 343/700 MS |
| 4,575,725 | A * | 3/1986 | Tresselt | ..... | 343/700 MS |
| 5,386,214 | A * | 1/1995 | Sugawara | ..... | 343/700 MS |
| 5,568,155 | A * | 10/1996 | Tsunekawa et al. | ... | 343/700 MS |
| 6,061,024 | A * | 5/2000 | McGirr et al. | ..... | 343/700 MS |
| 8,671,431 | B2 * | 3/2014 | Centore et al. | ..... | 725/71 |
| 2002/0070881 | A1 * | 6/2002 | Marcarelli et al. | ..... | 340/988 |

* cited by examiner

*Primary Examiner* — Tho G Phan
(74) *Attorney, Agent, or Firm* — Lowenstein Sandler LLP

(57) ABSTRACT

Methods and systems for radiating electromagnetic energy with a direct-feed patch antenna are described. The direct-feed patch antenna may be formed of a metal member of the user device and is grounded to the ground plane at a ground point disposed in relation to a feed location of the direct-feed patch antenna, the feed location to be directly coupled to receive a radio frequency (RF) signal. The direct-feed patch antenna is configured to radiate electromagnetic energy in response to the RF signal.

28 Claims, 15 Drawing Sheets

DIRECT FEED PATCH ANTENNA

BACKGROUND OF THE INVENTION

A large and growing population of users is enjoying entertainment through the consumption of digital media items, such as music, movies, images, electronic books, and so on. The users employ various electronic devices to consume such media items. Among these electronic devices (referred to herein as user devices) are electronic book readers, cellular telephones, personal digital assistants (PDAs), portable media players, tablet computers, netbooks, laptops, and the like. These electronic devices wirelessly communicate with a communications infrastructure to enable the consumption of the digital media items. In order to wirelessly communicate with other devices, these electronic devices include one or more antennas. Various types of antennas can be used in user devices.

A patch antenna is a type of radio antenna with a low profile, which can be mounted on a flat surface. It comprises a flat rectangular sheet or "patch" of metal, mounted over a larger sheet of metal called a ground plane. Patch antennas are simple to fabricate and easy to modify and customize. Typical patch antennas have two metal sheets that together form a resonant piece of transmission line with a length. The radiation mechanism arises from discontinuities at each truncated edge of the patch antenna.

BRIEF DESCRIPTION OF THE DRAWINGS

The present invention will be understood more fully from the detailed description given below and from the accompanying drawings of various embodiments of the present invention, which, however, should not be taken to limit the present invention to the specific embodiments, but are for explanation and understanding only.

DETAILED DESCRIPTION OF THE PRESENT INVENTION

Methods and systems for radiating electromagnetic energy with a direct-feed patch antenna are described. The direct-feed patch antenna may be formed of a metal member of the user device and is grounded to the ground plane at a ground point disposed in relation to a feed location of the direct-feed patch antenna, the feed location to be directly coupled to receive a radio frequency (RF) signal. The direct-feed patch antenna is configured to radiate electromagnetic energy in response to the RF signal. In one embodiment, the patch antenna can be configured to operate as a direct-feed patch antenna for Wi-Fi and GPS applications. A patch antenna element may be formed with a structural member of the user device and disposed in relation to the ground plane to form an opening at which the direct-feed patch antenna radiates electromagnetic energy. Alternatively, the patch antenna element may be formed with a non-structural member of the user device. For example, the structural member may be a metallic support member that supports a display of the user device, a circuit board, or a user input device of the user device. The structural member may also be a metallic housing of the user device, a metal portion of a non-metallic housing of the user device, a metallic bezel, or the like. The structural or non-structural member may be metal, metal alloy, or the like. The direct-feed patch antenna may be a three-dimensional (3D) structure. In one embodiment, the 3D structure includes a first side having a triangular shape disposed on a front side or a backside of the user device. This triangular shape may be disposed at one of the corners of the user device. In one embodiment, the patch antenna element has a polygon shape, such as a triangular shape. For example, a triangle shape patch antenna element can formed in a metallic member in one of the corners of the user device. In another embodiment, the patch antenna element has an organic shape. Organic shapes are those with a natural look and a flowing or curving appearance. Alternatively, the direct-feed patch antenna may be a two-dimensional (2D) structure. Also, the patch antenna may have other shapes as would be appreciated by one of ordinary skill in the art having the benefit of this disclosure.

The user device may be any content rendering device that includes a wireless modem for connecting the user device to a network. Examples of such user devices include electronic book readers, portable digital assistants, mobile phones, laptop computers, portable media players, tablet computers, cameras, video cameras, netbooks, notebooks, desktop computers, gaming consoles, DVD players, media centers, and the like. The user device may connect to a network to obtain content from a server computing system (e.g., an item providing system) or to perform other activities. The user device may connect to one or more different types of cellular networks.

Figure 1:
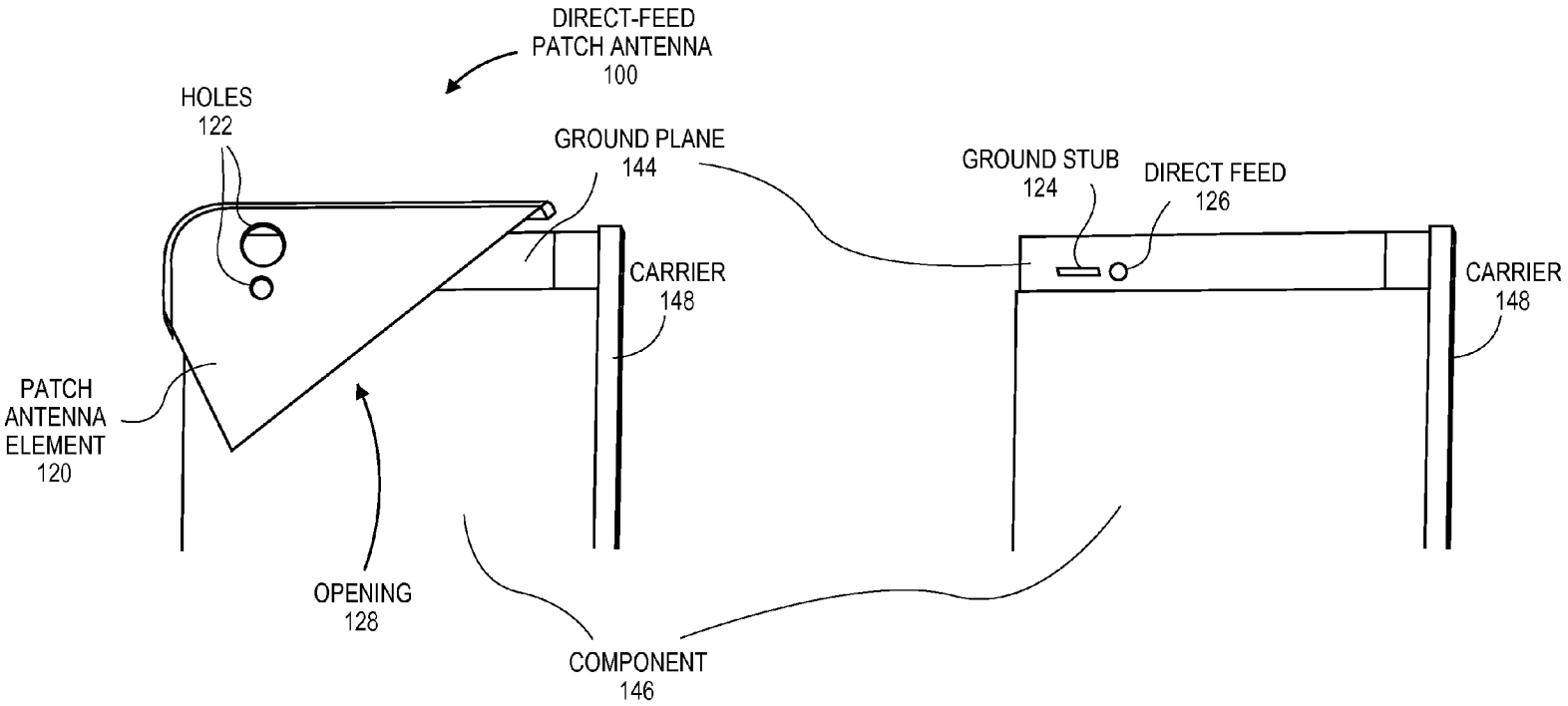
FIG. 1 illustrates perspective views of a direct-feed patch antenna including a patch antenna, a direct feed, and a ground stub disposed on a left side according to one embodiment.

FIG. 1 illustrates perspective views of a direct-feed patch antenna 100 including a patch antenna element 120, a direct feed 126, and a ground stub 124 disposed on a left side according to one embodiment. As described herein, the patch antenna element 120 may have a polygon shape that is formed in a metal member of a user device. In the depicted embodiment, the patch antenna element 120 has a triangular shape and is disposed in a corner of the user device above a ground plane 144. The ground plane 144 may be a metal frame of the user device. The ground plane 144 may be a system ground or one of multiple grounds of the user device. It should be noted in other embodiments, the patch antenna element 120 can be disposed below the ground plane 144, as well as in other orientations relative to the ground plane 144. In other embodiments, the ground plane 144 may be a printed circuit board (PCB).

In this embodiment, the direct-feed patch antenna 100 is fed at a direct feed 126 disposed on the patch antenna element 120. The direct feed 126 may be a feed line connector that couples the direct-feed patch antenna 100 to a feed line (also referred to as the transmission line), which is a physical connection that carriers the RF signal to and/or from the direct-feed patch antenna 100. The feed line connector may be any one of the three common types of feed lines, including coaxial feed lines, twin-lead lines, or waveguides. A waveguide, in particular, is a hollow metallic conductor with a circular or square cross-section, in which the RF signal travels along the inside of the hollow metallic conductor. Alternatively, other types of connectors can be used. In the depicted embodiment, the feed line connector is directly connected to patch antenna element 120 via the direct feed 126. It should also be noted that the patch antenna element 120 is also physically coupled to the ground plane at a grounding location disposed in relation to the feed location.

In the depicted embodiment, the direct feed 126 is disposed at a left side of the triangular shape. The patch antenna element 120 is formed of a metal member of the user device. This metal member may be structural or non-structural, such as a metal member that is used for decorative or aesthetic purposes. It should be noted that the metal member in the depicted embodiment includes two component access holes 122 for other components of the user device, such as cameras. In this embodiment, the ground stub 124 and the direct feed 126 are disposed near the holes 122 on the backside of the user device, but, in other embodiments, they are disposed in other locations. Also, in other embodiments, the ground stub 124 and direct feed 126 are disposed on other metal members of the user device. In this embodiment, a component 146, such as a battery, is disposed between the metal member on the backside and the ground plane 144. The ground plane 144 and components 146 may reside on a carrier 148 of the user device. The carrier 148 may be dielectric carrier and may be any non-conductive material, upon which the ground plane (or PCB) and other components can be disposed without making electrical contact with other metal within the user device, except at the portions of the patch antenna element 120 that are coupled to the ground plane 144.

In the depicted embodiment, the ground plane 144 is disposed in a first plane of the user device. The patch antenna element 120 is disposed in a second plane of the user device and is coupled to the ground plane at the grounding location via the ground stub 124. The ground stub 124 is disposed near the direct feed 126. In one embodiment, the distance between the ground stub 124 and direct feed 126 is less than 6 mm. By varying the distance, the frequency response of the patch antenna element 120 can be adjusted. In the depicted embodiment, the metal member includes a second side disposed on the top side of the user device and a third side disposed on the left side of the user device. The triangular portion may be coupled to the second and thirds or may be electrically isolated from the second and third sides. The second and third sides may not even be metal. The patch antenna element 120 may be part of the bezel disposed around the user device. As described herein, the patch antenna element 120 can be formed in other metal members of the device than the backside of the user device. Also, as described herein, the patch antenna element 120 can have different shapes than those depicted in the Figures and described herein.

Figure 7:
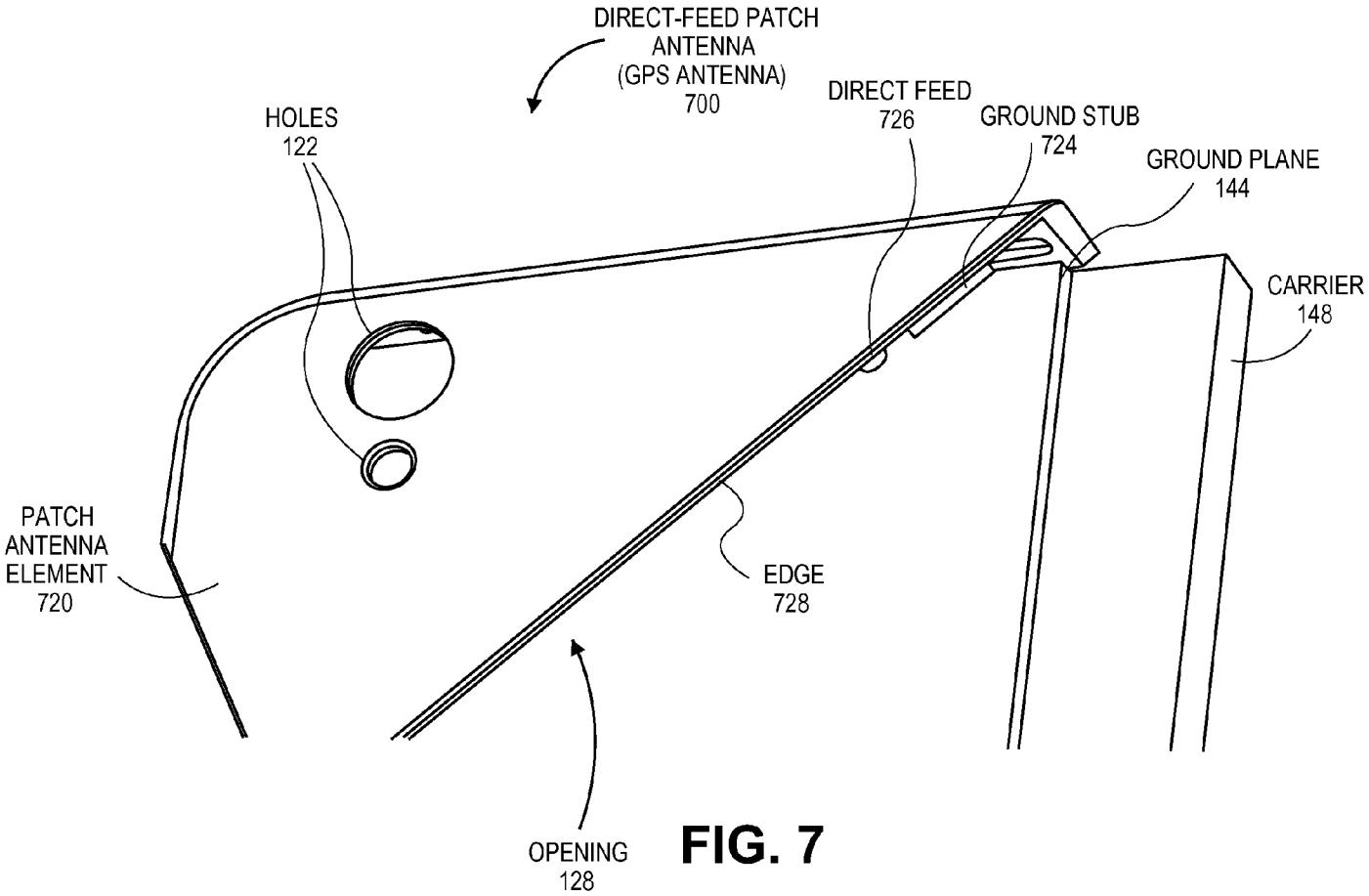
FIG. 7 illustrates a perspective view of a direct-feed patch antenna in which a direct feed and a ground stub are disposed at or near an edge according to one embodiment.
Figure 9:
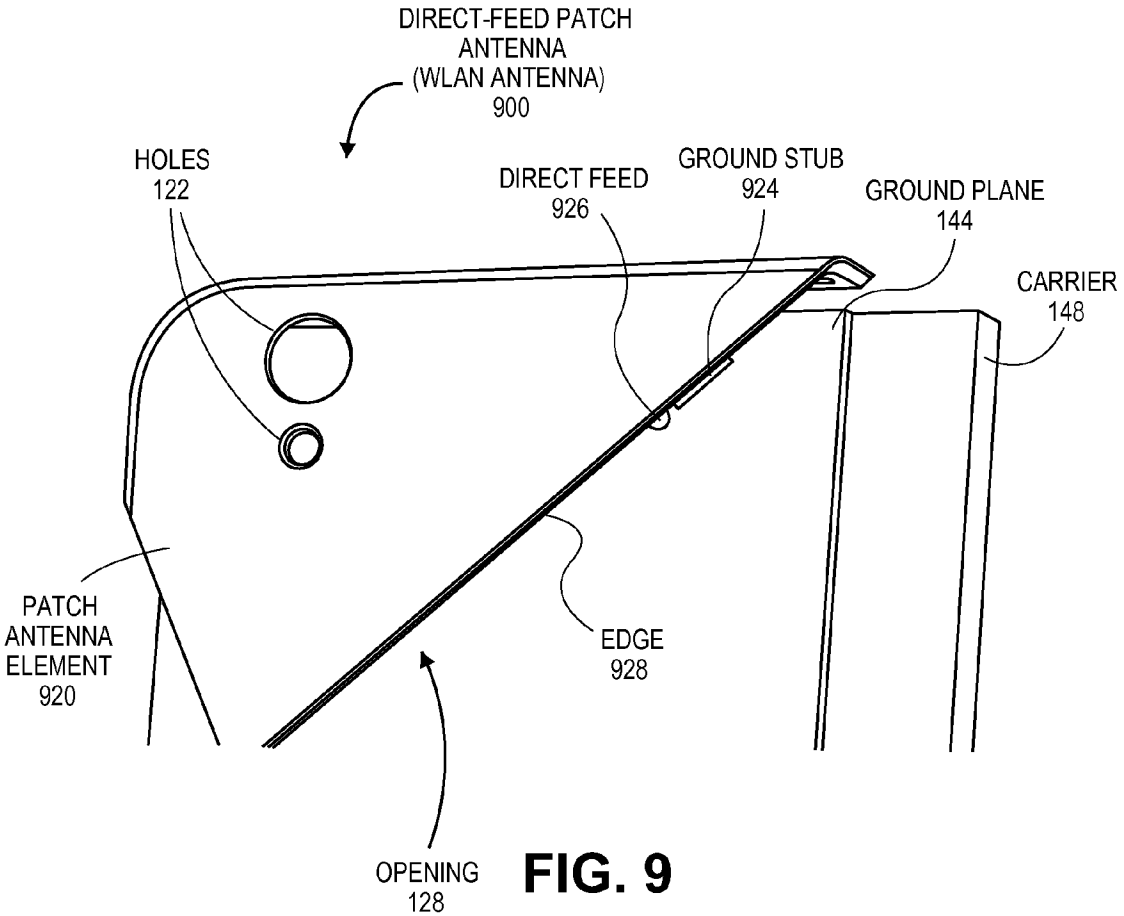
FIG. 9 illustrates a perspective view of a direct-feed patch antenna for a WLAN antenna in which a direct feed and a ground stub are disposed at or near an edge according to one embodiment.
Figure 11:
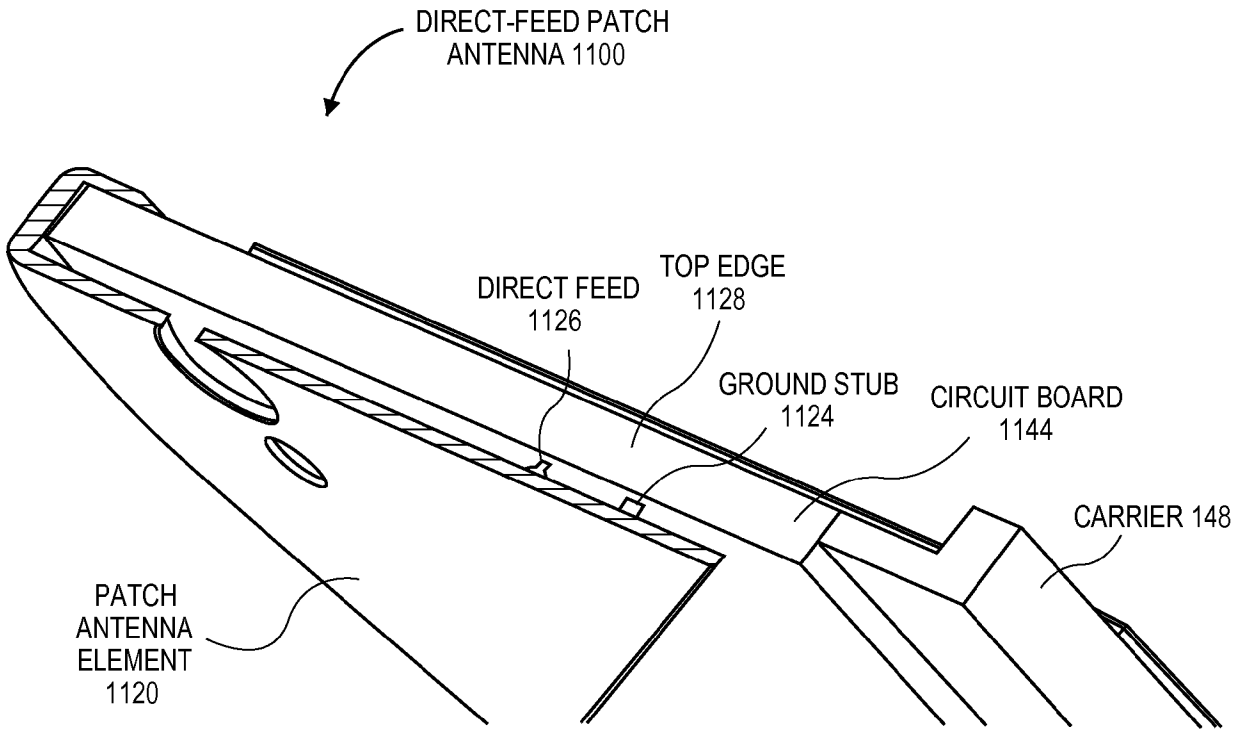
FIG. 11 illustrates a perspective view of a direct-feed patch antenna in which a direct feed and a ground stub are disposed at or near a top edge of a circuit board according to one embodiment.

In the depicted embodiment, the patch antenna element 120 includes a first portion disposed in the second plane, the first portion having a triangular shape, a second portion disposed in a third plane perpendicular to the first and second planes, and a third side disposed in a fourth plane perpendicular to the first and second planes and orthogonal to the third plane. In this embodiment, the feed location and the grounding location are disposed at an edge of the triangular shape, and wherein the second and third sides are not directly coupled to the ground plane. In one embodiment, the placement of the feed location and the grounding location can be chosen for convenience of interfacing with the circuit board or other components of the user device. In various embodiments, the direct feed 126 is disposed at a feed location at the metal member and the ground stub is disposed at a grounding location disposed in relation to the feed location. In one embodiment, the grounding location and the feed location are disposed on a first side of the metal member, such as the left side illustrated in FIG. 1 and FIG. 5 or the right side as illustrated in FIGS. 3, 7, 9, & 11. In another embodiment, the grounding location and the feed location are disposed at or near an edge of the metal member, such as illustrated in FIGS. 3, 7, 9, & 11. In another embodiment, the grounding location and the feed location are disposed on the metal member to correspond to a top edge of a circuit board disposed between the patch antenna and the ground plane, such as illustrated in FIG. 11. In another embodiment, the metal member includes three sides and one of the three sides is a diagonal side, and the grounding location and the feed location are disposed at or near the diagonal side, such as illustrated in FIGS. 7 & 9. In another embodiment, the metal member includes multiple sides, one of which is a top side, and the grounding location and the feed location are disposed at or near the top side, such as illustrated in FIG. 11. Alternatively, the grounding location and the feed location are disposed in other configurations as would be appreciated by one of ordinary skill in the art having the benefit of this disclosure. It should also be noted that the metal member for the patch antenna element 120 is a triangular shape, such as a corner backside part of the user device; however, in other embodiments, the metal member may be other polygon shapes, or any organic shape as necessitated by the design of the user device.

In one embodiment, the metal member is a structural member of the user device. The structural member may be a metallic support member that supports a circuit board of the user device, a metallic support member that supports a display of the user device, a metallic support member that supports a user input device, a metal back panel of an assembly that supports the circuit board, a metallic housing of the user device, a metal portion of a non-metallic housing of the user device, or a metallic bezel of the user device. Alternatively, the structural member may be a metallic support member that supports a user input device, such as a touch screen, touchpad, or touch panel. Alternatively, other structural members of the user device may be used. In other embodiments, the metal member is a non-structural member of the user device, such as metal that is used for ornamental or aesthetic purposes.

In the depicted embodiment, the direct-feed patch antenna 100 is configured to radiate at an opening 128 between the patch antenna element 120 and the ground plane 140. The patch antenna element 120 is configured to operate as a direct-feed patch antenna radiator with the direct feed 126 and ground stub 124. The feed location, the distance between the feed location and the grounding location, and the surface area of the patch antenna element 120 contribute to resonant frequencies of the patch antenna structure 120. In one embodiment, the patch antenna element 120 is configured to operate as a global positioning system (GPS) antenna. The GPS antenna may cover a GPS frequency band, such as 1.575 GHz frequency band. In another embodiment, the patch antenna element 120 is configured to operate as a wireless local area network (WLAN) antenna. Most modern WLAN antennas are based on IEEE 802.11 standards, marketed under the Wi-Fi brand name. The WLAN antenna may cover a WLAN frequency band, such as the WiFi frequency bands of 2.45 GHZ, 5 GHz, or both. The Wi-Fi frequency bands may also include 3.7 GHz. In one embodiment, the patch antenna element 120 is configured to provide a single resonant mode. In another embodiment, the patch antenna element 120 is configured to provide multiple resonant modes. In one embodiment, the patch antenna element 120 is configured to provide a first resonant mode and a second resonant mode. In one embodiment, the first resonant mode covers a first Wi-Fi frequency band and the second resonant mode covers a second Wi-Fi frequency band. In another embodiment, the first resonant mode covers a GPS frequency band, and the second resonant mode covers a Wi-Fi frequency band. In one embodiment, the first frequency band is a 1.575 GHz frequency band and the second frequency band is 5 GHz frequency band. In another embodiment, the first frequency band is a 2.45 GHz frequency band and the second frequency band is 5.8 GHz frequency band. Alternatively, the patch antenna element 120 can be configured to provide more or less resonant modes and may be in other frequency ranges as would be appreciated by one of ordinary skill in the art having the benefit of this disclosure. Alternatively, other frequency bands may be achieved by changing the feed location, the distance between the feed location and the grounding location, the surface area of the patch antenna element 120, as well as other dimensions of the direct-feed patch antenna 100.

In some embodiments, the opening 128 between the patch antenna element 120 and the ground plane 144 is an air gap. In another embodiment, dielectric material may be disposed between the patch antenna element 120 and the ground plane 144. In another embodiment, one or more components or carriers may be disposed between portions between the patch antenna element 120 and the ground plane 144. In one embodiment, the patch antenna element 120 is disposed on an antenna carrier, such as a dielectric carrier of the user device. The antenna carrier may be any non-conductive material, such as dielectric material, upon which the conductive material of the direct-feed patch antenna 100 can be disposed without making electrical contact with other metal within the user device, except at the grounding location of the patch antenna element 120 that is coupled to the ground plane 144. In another embodiment, portions of the direct-feed patch antenna 100, such as the direct feed 126, may be disposed on or within a circuit board, such as a printed circuit board (PCB). Alternatively, the direct-feed patch antenna 100 may be disposed on other components of the user device or within the user device as would be appreciated by one of ordinary skill in the art having the benefit of this disclosure. It should be noted that the direct-feed patch antenna 100 illustrated in FIG. 1 is a planar, three-dimensional (3D) structure, including the triangular portion in the second plane, and the second and third portions that are disposed perpendicular to the second plane. However, the direct-feed patch antenna 100 may include 2D structures, such as the triangular portion without the second and third portions, as well as other variations than those depicted in FIG. 1.

Figure 2:
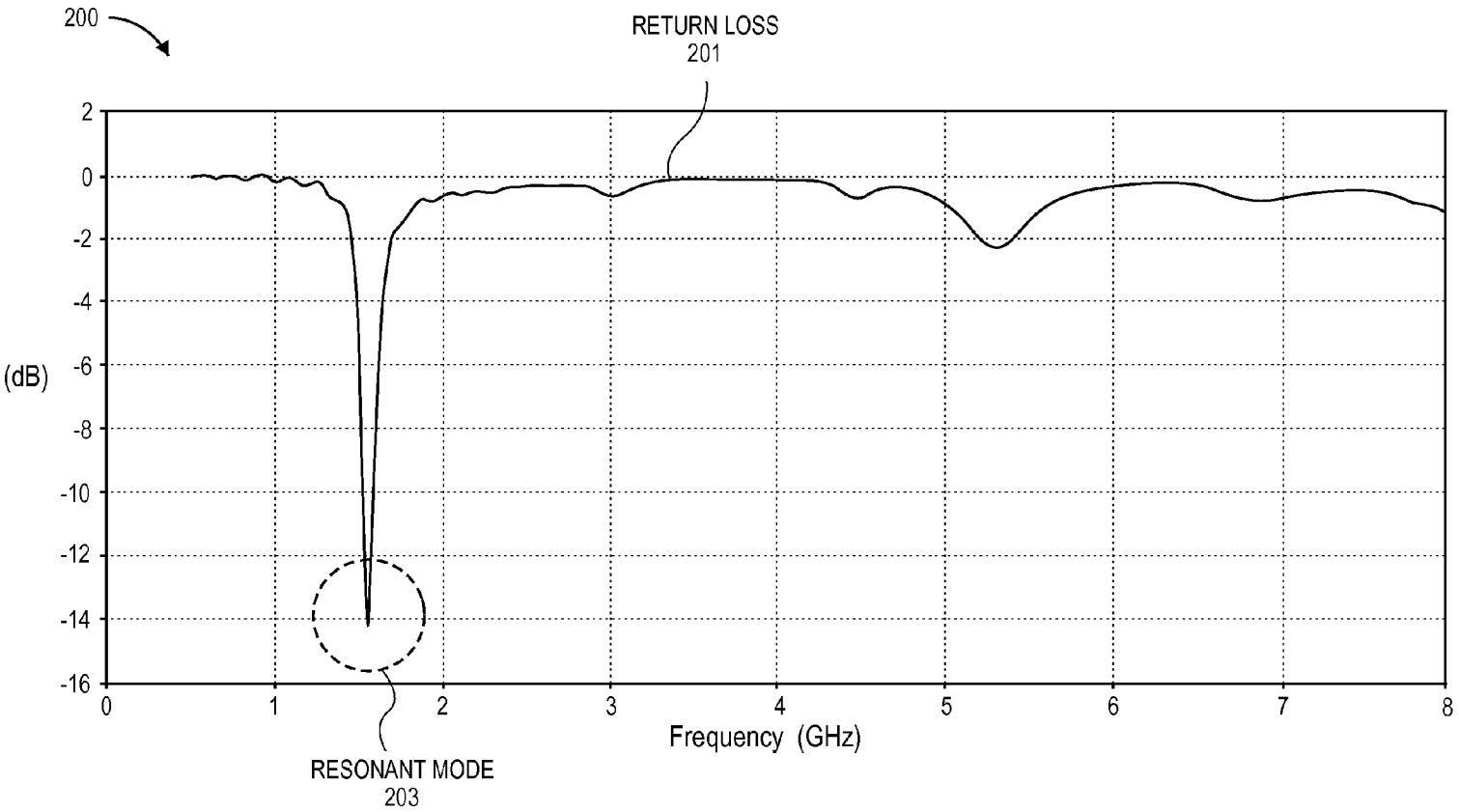
FIG. 2 is a graph of a return loss of the direct-feed patch antenna of FIG. 1 according to one embodiment.

FIG. 2 is a graph of a return loss of the direct-feed patch antenna of FIG. 1 according to one embodiment. The graph 200 shows the return loss 201 of the direct-feed patch antenna 100. Return loss is the negative of the reflection coefficient expressed in decibels. The use of return loss and reflection are used interchangeable herein, but the graphs specifically show the reflection coefficient of the different antenna structures. In this embodiment, the direct-feed patch antenna 100 includes a resonant mode 203. In the depicted embodiment, the resonant mode 203 is at the 1.575 GHz frequency band. Alternatively, other resonant modes may be achieved as would be appreciated by one of ordinary skill in the art having the benefit of this disclosure. In one embodiment, the resonant mode 203 may be used for GPS applications, as described herein. Alternatively, other frequency ranges may be covered for other types of applications.

Figure 3:
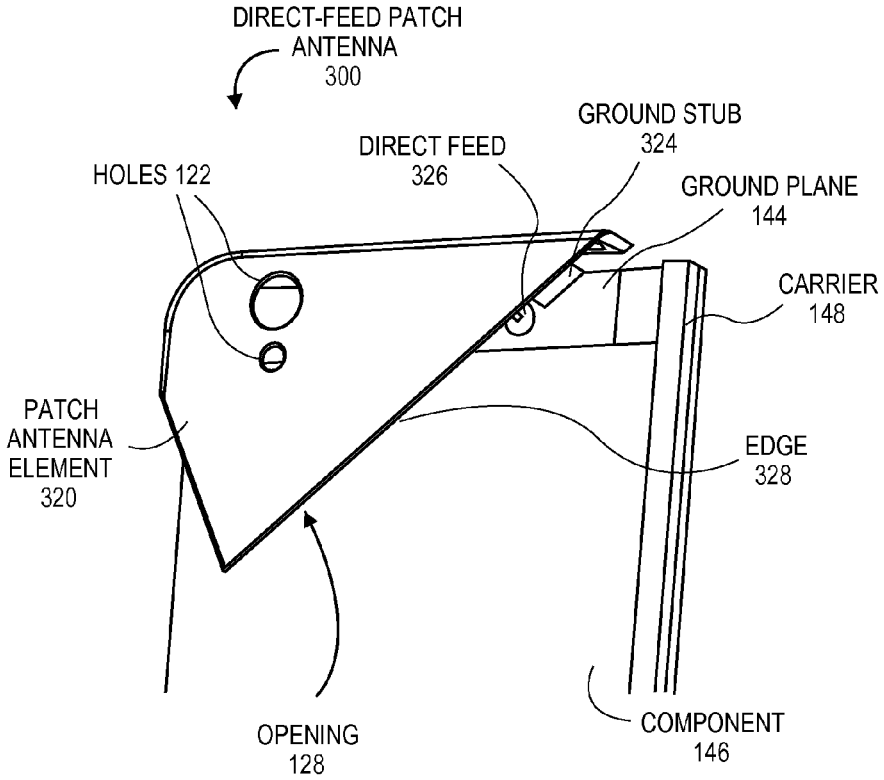
FIG. 3 illustrates a perspective view of a direct-feed patch antenna including a direct feed and a ground stub disposed on a right side according to one embodiment.
Figure 4:
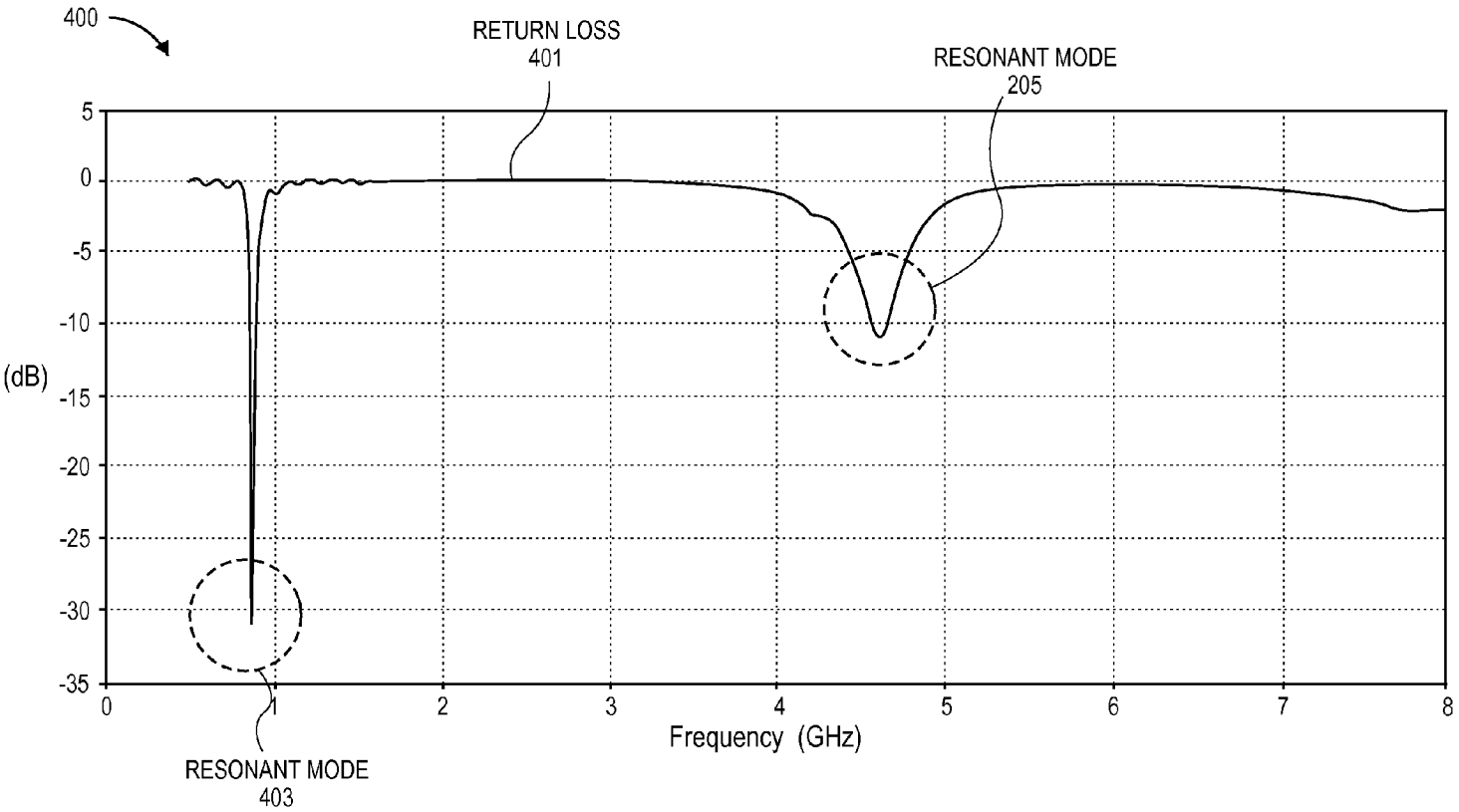
FIG. 4 is a graph of a return loss of the direct-feed patch antenna of FIG. 3 according to one embodiment.

FIG. 3 illustrates a perspective view of a direct-feed patch antenna 300 including a direct feed 326 and a ground stub 324 disposed on a right side according to one embodiment. The direct-feed patch antenna 300 is similar to the direct-feed patch antenna 100 as noted by similar reference numbers. The direct-feed patch antenna 300 includes the patch antenna element 320, which has the triangular shape and is disposed in a corner of the user device above the ground plan 144. Unlike the direct-feed patch antenna 100, the direct feed 326 and the ground stub 324 are disposed on a right side of the user device. The position of the direct feed 326 and the ground stub 324 may change the return loss of the direct-feed patch antenna 300 as shown in FIG. 4. It should be noted that the ground plane 144 could be part of the PCB and the components is disposed above the PCB.

FIG. 4 is a graph of a return loss of the direct-feed patch antenna 300 of FIG. 3 according to one embodiment. The graph 400 shows the return loss 401 of the direct-feed patch antenna 300 with the direct feed 326 and ground stub 324 disposed on the right side. In this embodiment, the direct-feed patch antenna 300 includes a first resonant mode 403 and a second resonant mode 405. In the depicted embodiment, the first resonant mode 403 is at the 900 MHz frequency band and the second resonant mode 406 is at 4.6 GHz frequency band.

Figure 5:
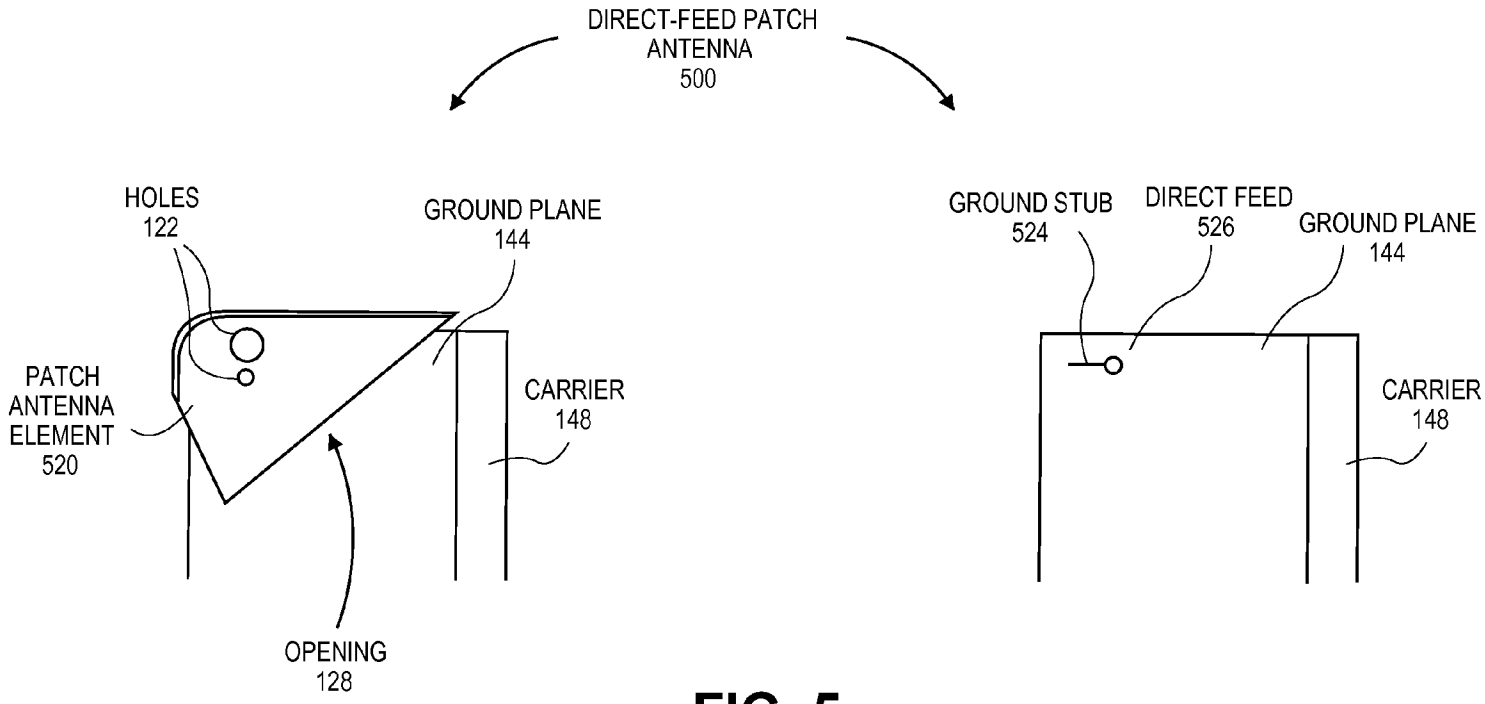
FIG. 5 illustrates perspective views of a direct-feed patch antenna including a direct feed and a ground stub disposed on a left side according to another embodiment.

FIG. 5 illustrates perspective views of a direct-feed patch antenna 500 including a direct feed 526 and a ground stub 524 disposed on a left side according to another embodiment. The direct-feed patch antenna 500 is similar to the direct-feed patch antenna 100 as noted by similar reference numbers. The direct-feed patch antenna 500 includes the patch antenna element 520, which has the triangular shape and is disposed in a corner of the user device above the ground plan 144. Unlike the direct-feed patch antenna 100, there is no intervening component 146 between the metal member of the patch antenna element 520 and the ground plane 144 in the direct-feed patch antenna 500. The height of the gap between the ground plane 144 and the patch antenna element 520 in the direct-feed patch antenna 500 is less than the height of the gap between the ground plane 144 and the patch antenna element 120 in the direct-feed patch antenna 100 of FIG. 1. In one embodiment, the component 146, illustrated in FIG. 1, is disposed on the other side of the ground plane 144. Alternatively, the component 146 may not be part of the user device or may be disposed elsewhere. The direct feed 526 and the ground stub 524 are disposed on a left side of the user device. The height of the patch antenna element 520 and the ground plane 144 changes the return loss of the direct-feed patch antenna 500 of the direct-feed patch antenna 500 as shown in FIG. 6.

Figure 6:
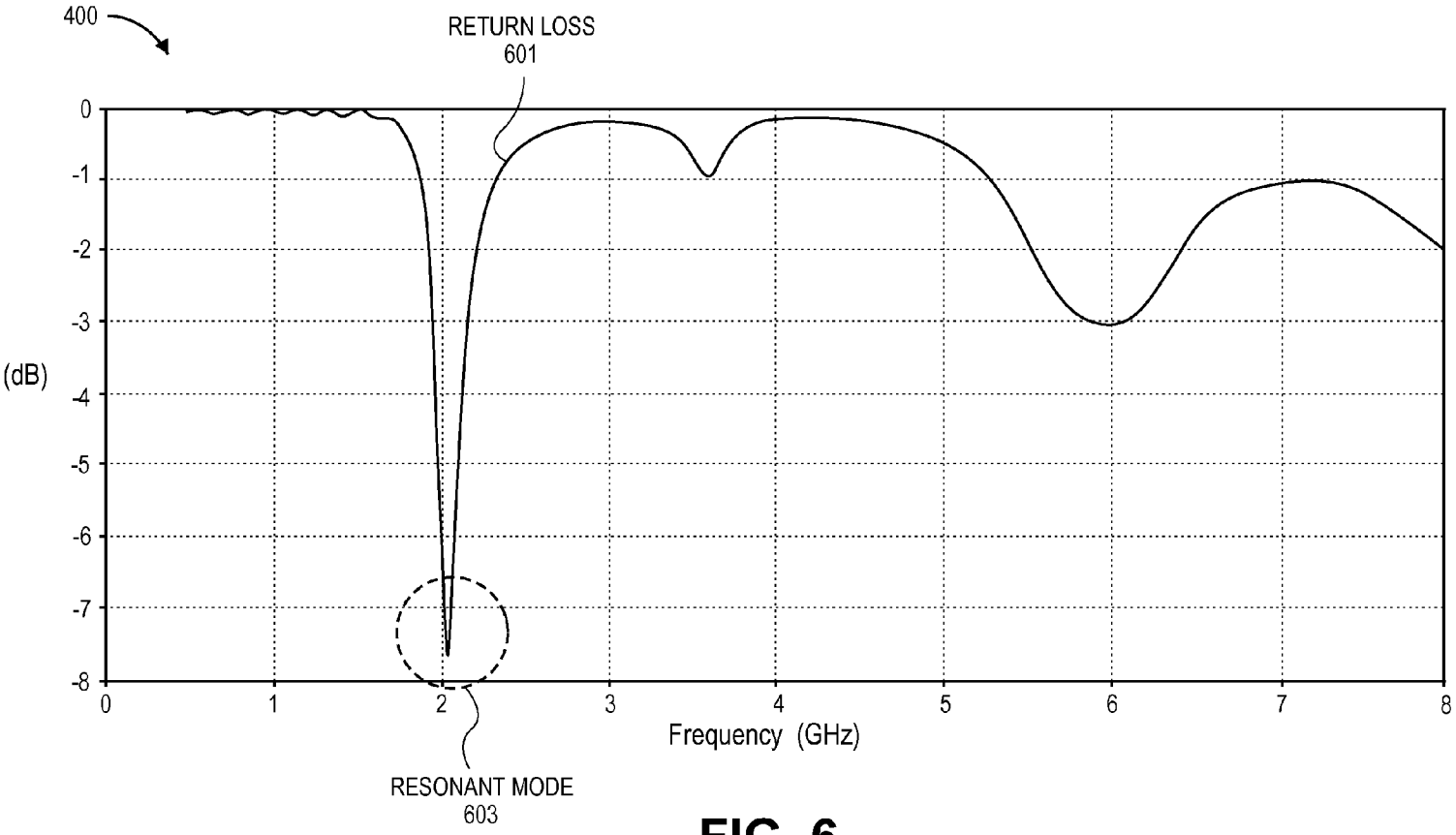
FIG. 6 is a graph of a return loss of the direct-feed patch antenna of FIG. 5 according to one embodiment.

FIG. 6 is a graph of a return loss of the direct-feed patch antenna 500 of FIG. 5 according to one embodiment. The graph 600 shows the return loss 601 of the direct-feed patch antenna 500 with the direct feed 526 and ground stub 524 disposed on the left side and the smaller height in the gap above the ground plane 144. In this embodiment, the direct-feed patch antenna 500 includes a first resonant mode 603 and a second resonant mode 605. In the depicted embodiment, the first resonant mode 603 is at the 2.1 GHz frequency band.

FIG. 7 illustrates a perspective view of a direct-feed patch antenna 700 in which a direct feed 726 and a ground stub 724 are disposed at or near an edge 728 according to one embodiment. The direct-feed patch antenna 700 is similar to the direct-feed patch antenna 100 as noted by similar reference numbers. The direct-feed patch antenna 700 includes the patch antenna element 720, which has the triangular shape and is disposed in a corner of the user device above the ground plan 144. Unlike the direct-feed patch antenna 100, there is no intervening component 146 between the metal member (e.g., patch antenna element 720 and the ground plane 144 in the direct-feed patch antenna 700. Also, unlike the direct-feed patch antennas 100 and 300, the direct feed 726 and the ground stub 724 are disposed at or near an edge 728 on the right side of the user device. In particular, the direct feed 726 and the ground stub 724 are disposed at or near a diagonal side of the triangular portion. The edge 728 may be a convenient location for the feed location and the grounding location of the patch antenna element 720. The locations of the direct feed 726 in relation to the ground stub 724 may impact the frequency response of the direct-feed patch antenna 700, as well as the height of the gap between the ground plane 144 and the patch antenna element 720. The height of the gap between the ground plane 144 and the patch antenna element 720 in the direct-feed patch antenna 700 is less than the height of the gap between the ground plane 144 and the patch antenna element 120 and 320 in the direct-feed patch antennas 100 and 300 and may be the same as that of the direct-feed patch antenna 500.

Figure 8:
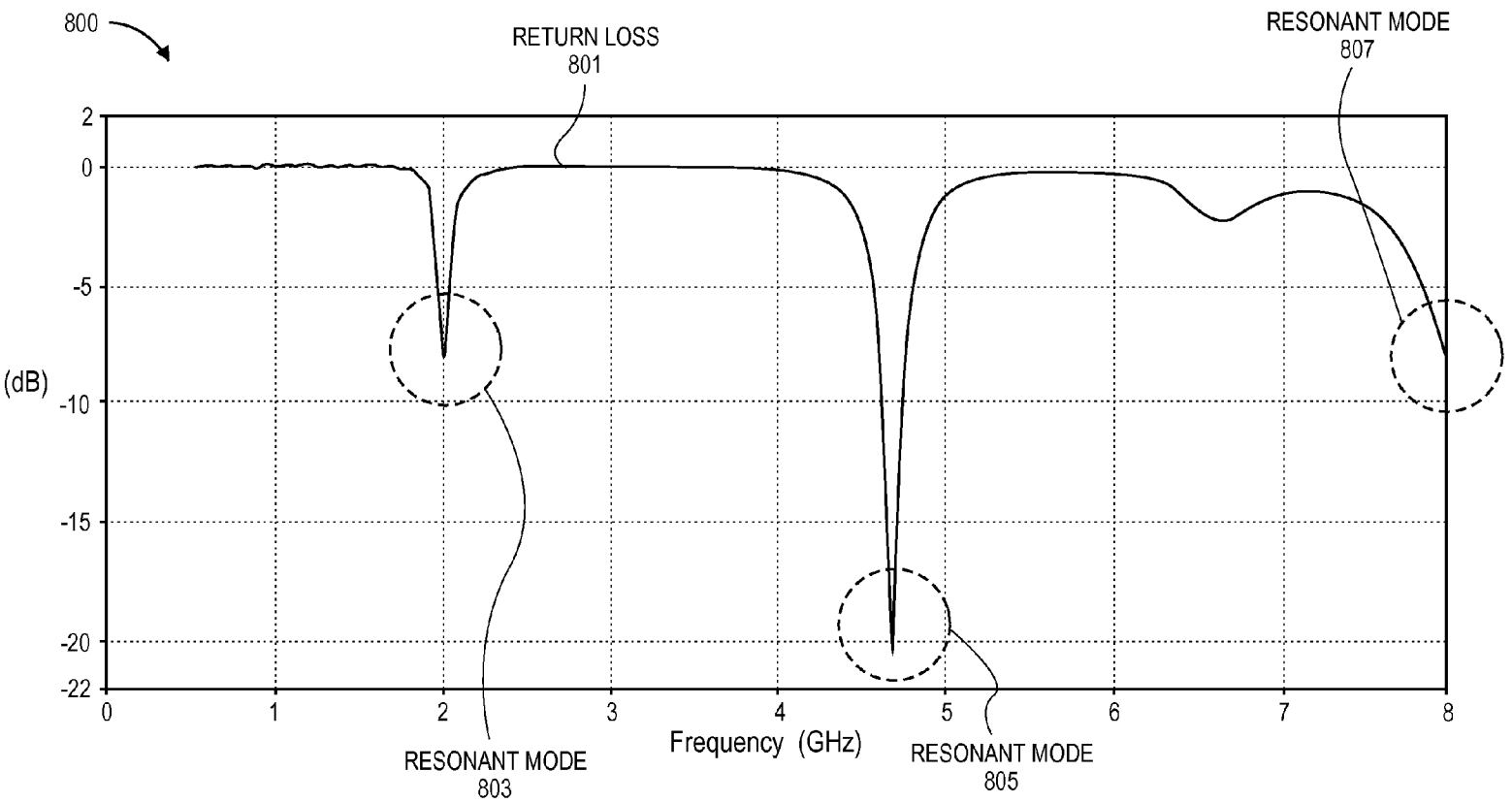
FIG. 8 is a graph of a return loss of the direct-feed patch antenna of FIG. 7 according to one embodiment.

FIG. 8 is a graph of a return loss of the direct-feed patch antenna 700 of FIG. 7 according to one embodiment. The graph 800 shows the return loss 801 of the direct-feed patch antenna 700 with the direct feed 726 and the ground stub 724 disposed at or near the edge 728. In this embodiment, the direct-feed patch antenna 700 includes a first resonant mode 803 at 2 GHz, a second resonant mode 805 at 4.7 GHz, and a third resonant mode 807 at 8 GHz.

In some embodiments, the direct-feed patch antennas 100, 300, 500, and 700 may be used as GPS antennas. In some embodiments, GPS applications utilize 1.575 GHz, 1.227 GHz, or both for communications. In some embodiments, one resonant mode may be used for a GPS application and another resonant mode may be used for another application. In other embodiments, the direct-feed patch antennas 100, 300, 500, and 700 may be used for other types of antennas for other applications than GPS application, such as WLAN applications described below, as well as other applications as would be appreciated by one of ordinary skill in the art having the benefit of this disclosure.

FIG. 9 illustrates a perspective view of a direct-feed patch antenna 900 for a WLAN antenna in which a direct feed 926 and a ground stub 924 are disposed at or near an edge 928 according to one embodiment. The direct-feed patch antenna 900 is similar to the direct-feed patch antenna 700 as noted by similar reference numbers. The direct-feed patch antenna 900 includes the patch antenna element 920, which has the triangular shape and is disposed in a corner of the user device above the ground plan 144. The direct feed 926 and the ground stub 924 are disposed at or near an edge 928 on the right side of the user device. In particular, the direct feed 926 and the ground stub 924 are disposed at or near a diagonal side of the triangular portion. The edge 928 may be a convenient location for the feed location and the grounding location of the patch antenna element 120. In this embodiment, the location of the direct feed 926 and the ground stub 924 are farther away from the top right corner of the triangular portion than the locations of the direct feed 726 and the ground stub 724 of FIG. 7. Also, the distance between the direct feed 926 and the ground stub 924 is less than the distance between the direct feed 726 and the ground stub 724. The location of the direct feed 926 in relation to the ground stub 924 and the distance between them may impact the frequency response of the direct-feed patch antenna 900. Also, as described herein, the height of the gap between the ground plane 144 and the patch antenna element 920 may impact the frequency response. The height of the gap between the ground plane 144 and the patch antenna element 920 in the direct-feed patch antenna 900 is less than the height of the gap between the ground plane 144 and the patch antenna element 120 and 320 in the direct-feed patch antennas 100 and 300 and may be the same as that of the direct-feed patch antennas 500 and 700.

Figure 10:
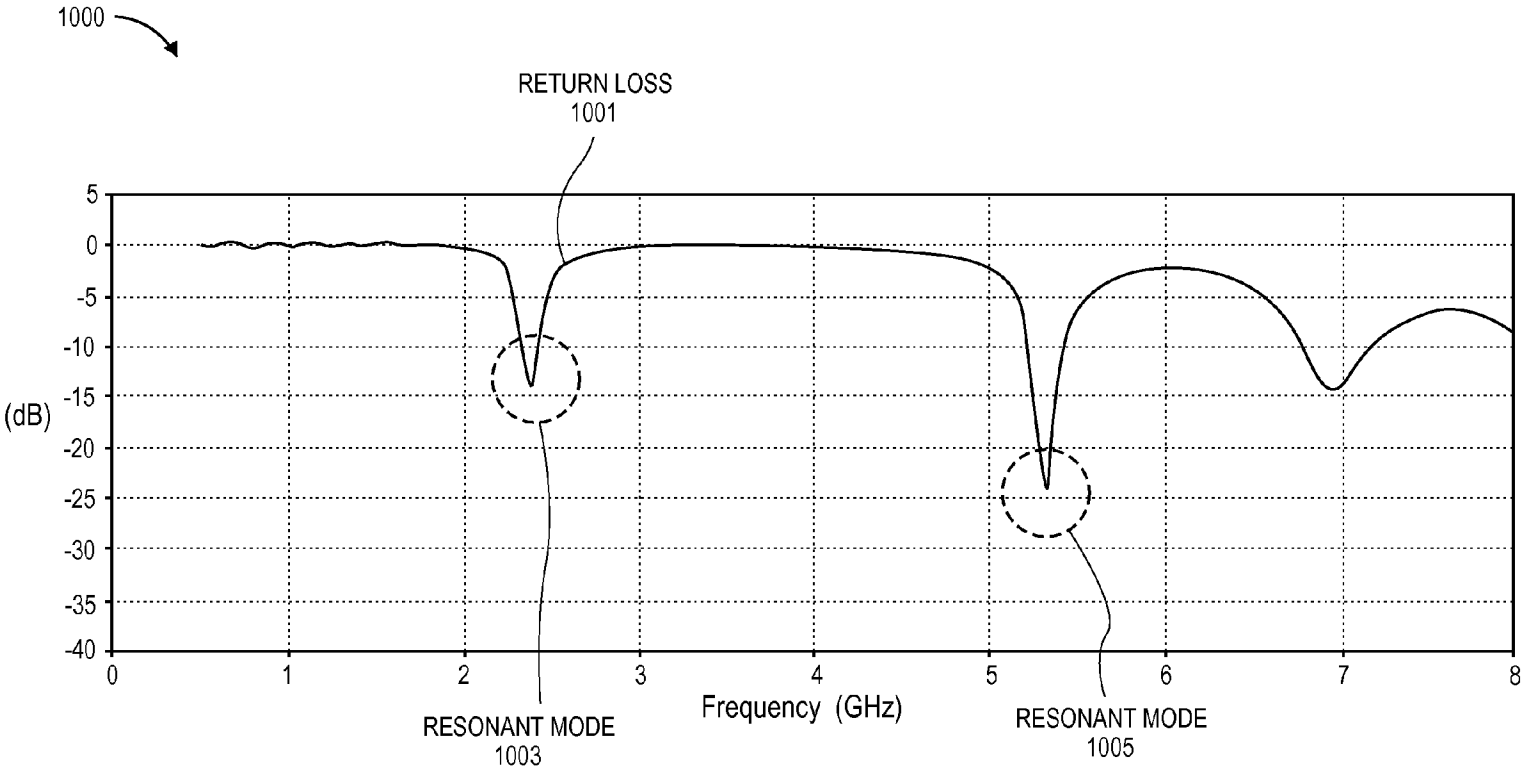
FIG. 10 is a graph of a return loss of the direct-feed patch antenna of FIG. 9 according to one embodiment.

FIG. 10 is a graph of a return loss of the direct-feed patch antenna 900 of FIG. 9 according to one embodiment. The graph 1000 shows the return loss 1001 of the direct-feed patch antenna 900 with the direct feed 926 and the ground stub 924 disposed at or near the edge 928. In this embodiment, the direct-feed patch antenna 900 includes a first resonant mode 1003 at 2.4 GHz, a second resonant mode 1005 at 5.3 GHz, and a third resonant mode 1007 at 6.9 GHz. The direct-feed patch antenna 900 may also provide a fourth resonant mode at 8.2 GHz.

FIG. 11 illustrates a perspective view of a direct-feed patch antenna 1100 in which a direct feed 1126 and a ground stub 1124 are disposed at or near an top edge 1128 of a circuit board 1144 according to one embodiment. The direct-feed patch antenna 1100 is similar to the direct-feed patch antenna 900 as noted by similar reference numbers. The direct-feed patch antenna 1100 includes the patch antenna element 1120, which has the triangular shape and is disposed in a corner of the user device above the ground plan 144. The direct feed 1126 and the ground stub 1124 are disposed at or near top edge 1128 of the patch antenna element 1120 to correspond to a top edge of the circuit board 1144. The circuit board 111 includes a ground plane and the ground stub 1124 is coupled to the ground plane. The top edge 1128 may be a convenient location for the feed location and the grounding location. The top edge 1128 may also be a convenient location for coupling to the circuit board 1144. The location of the direct feed 1126 and the ground stub 1124 may be adjusted along the top edge 1128 as would be appreciated by one of ordinary skill in the art having the benefit of this disclosure. In this embodiment, the carrier 148 is used to support the circuit board 1144. Also, another component may be disposed on the other side of the circuit board 1144 and the carrier 148 as illustrated in FIG. 11. The height of the gap between the patch antenna element 1120 and the circuit board 1144 may impact the frequency response. In this embodiment, the height of the gap between the patch antenna element 1120 and the circuit board 1144 may be less than the height of the gap between the ground plane 144 and the patch antenna element 120 and 320 in the direct-feed patch antennas 100 and 300 and may be the same as that of the direct-feed patch antennas 500, 700, and 900.

Alternatively, the height of the gap between the patch antenna element 1120 and the circuit board 1144 may be greater than or less than that of the direct-feed patch antennas 500, 700, and 900.

Figure 12:
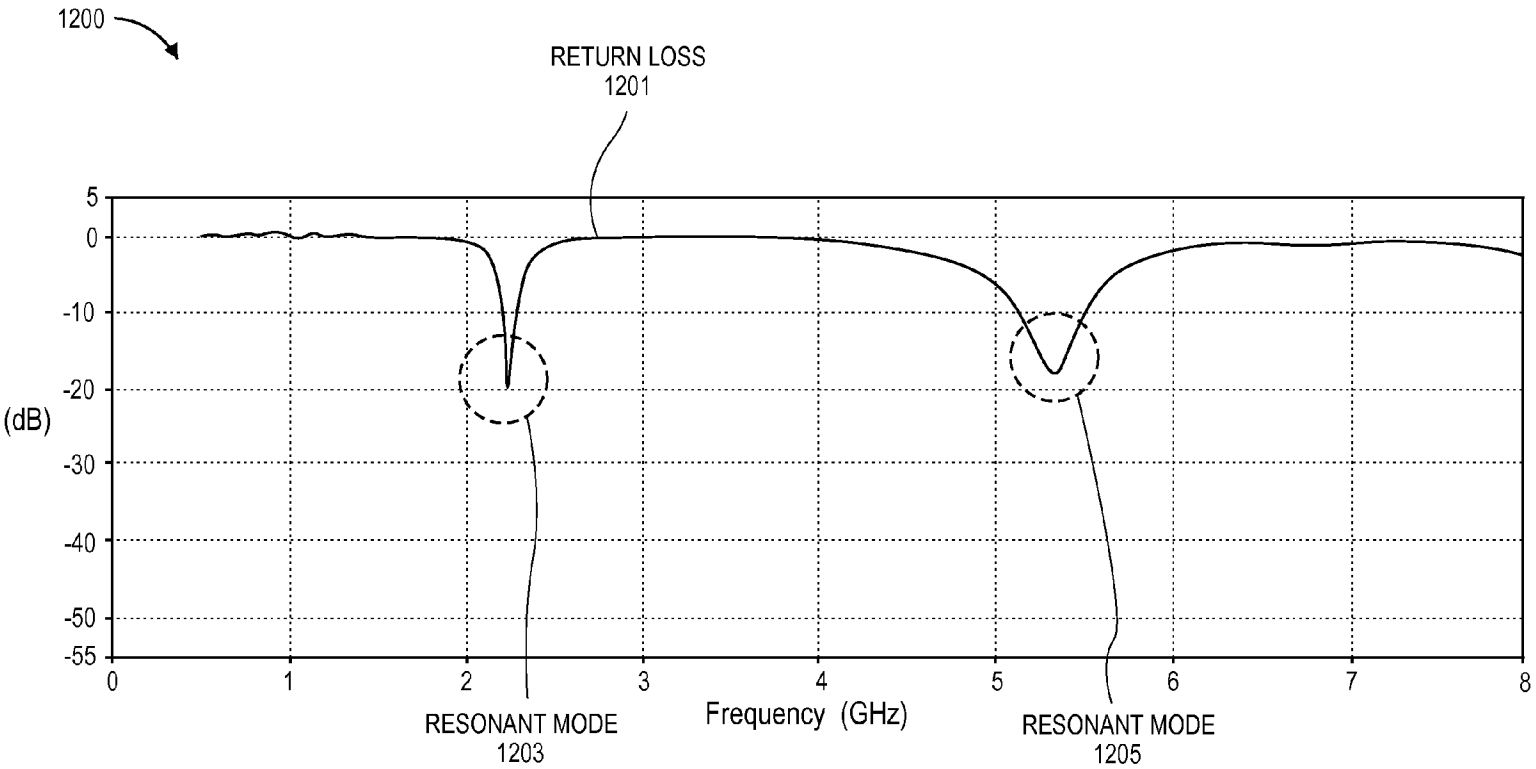
FIG. 12 is a graph of a return loss of the direct-feed patch antenna of FIG. 11 according to one embodiment.

FIG. 12 is a graph of a return loss of the direct-feed patch antenna of FIG. 11 according to one embodiment. The graph 1200 shows the return loss 1201 of the direct-feed patch antenna 1100 with the direct feed 1126 and the ground stub 1124 disposed at or near the top edge 1128. In this embodiment, the direct-feed patch antenna 1100 includes a first resonant mode 1203 at about 2.4 GHz and a second resonant mode 1205 at about 5 GHz.

Alternatively, other resonant modes may be achieved as would be appreciated by one of ordinary skill in the art having the benefit of this disclosure. Alternatively, other frequency ranges may be covered for other types of applications.

In some embodiments, the direct-feed patch antennas 900 and 1100 may be used as WLAN antennas. In some embodiments, WLAN applications utilize 2.4 GHz, 5 GHz, 3.7 GHz, or any combination thereof, for communications. In some embodiments, one resonant mode may be used for a GPS application and another resonant mode may be used for WLAN application. In other embodiments, the direct-feed patch antennas 900 and 1100 may be used for other types of antennas for other applications than WLAN applications as would be appreciated by one of ordinary skill in the art having the benefit of this disclosure.

Figure 13:
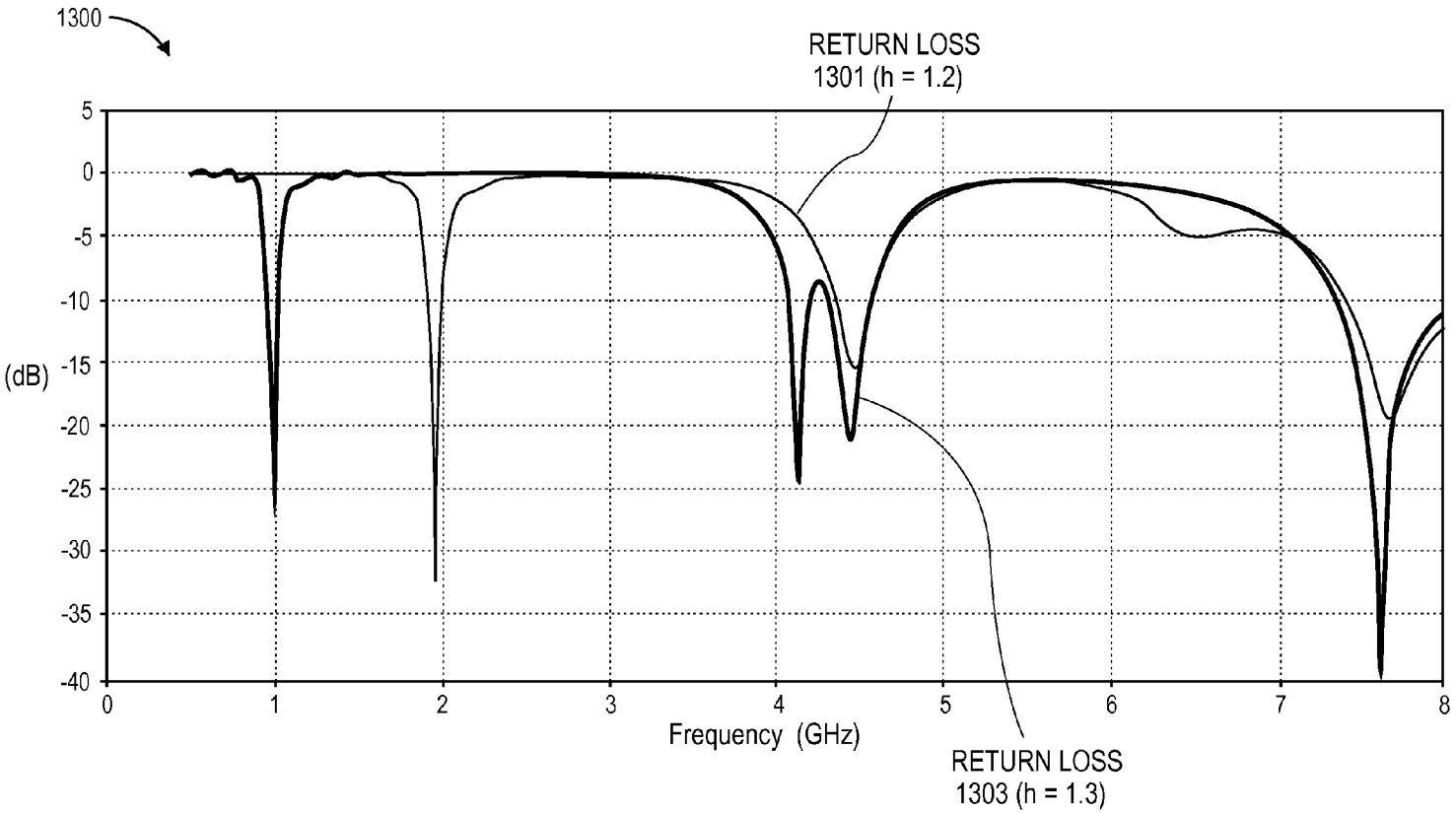
FIG. 13 is a graph of a return loss of the direct-feed patch antenna at two height clearances according to one embodiment.

FIG. 13 is a graph of a return loss of the direct-feed patch antenna at two height clearances according to one embodiment. The graph 1300 shows the return loss 1301 of a first direct-feed patch antenna having a first gap with a first height and the return loss 1303 of a second direct-feed patch antenna having a second gap with a second height. The first and second heights are the clearances of the gap between the patch antenna and the ground plane. In one embodiment, the first gap has a height of 1.2 mm and the second gap has a height of 1.3 mm. The return loss 1301 includes a first resonant mode at 2.0 GHz, a second resonant mode at 4.4 GHz, and a third resonant mode at 7.6 GHz. Similar resonances occur for structures with heights lower than 1.2 mm. The return loss 1303 includes a first resonant mode at 1 GHz, a second resonant mode at 4.2 GHz, a third resonant mode at 4.4 GHz, and a fourth resonant mode at 7.6 GHz. Similar resonances occur for structures with heights greater than 1.3 mm. In other embodiments, other heights may be used. For example, the height may range between 0.87 and 5.435 and provide different resonant modes. For example, the following heights have been simulated and resulted in resonant modes at approximately 1 GHz, 2 GHz, 4-4.5 GHz, and 7-8 GHz: 0.87, 3.1525, 5.435, 7.7175, 10, 1, 1.5, 2, 2.5, 3, 1.1, 1.2, 1.3, and 1.4 mm.

Figure 14:
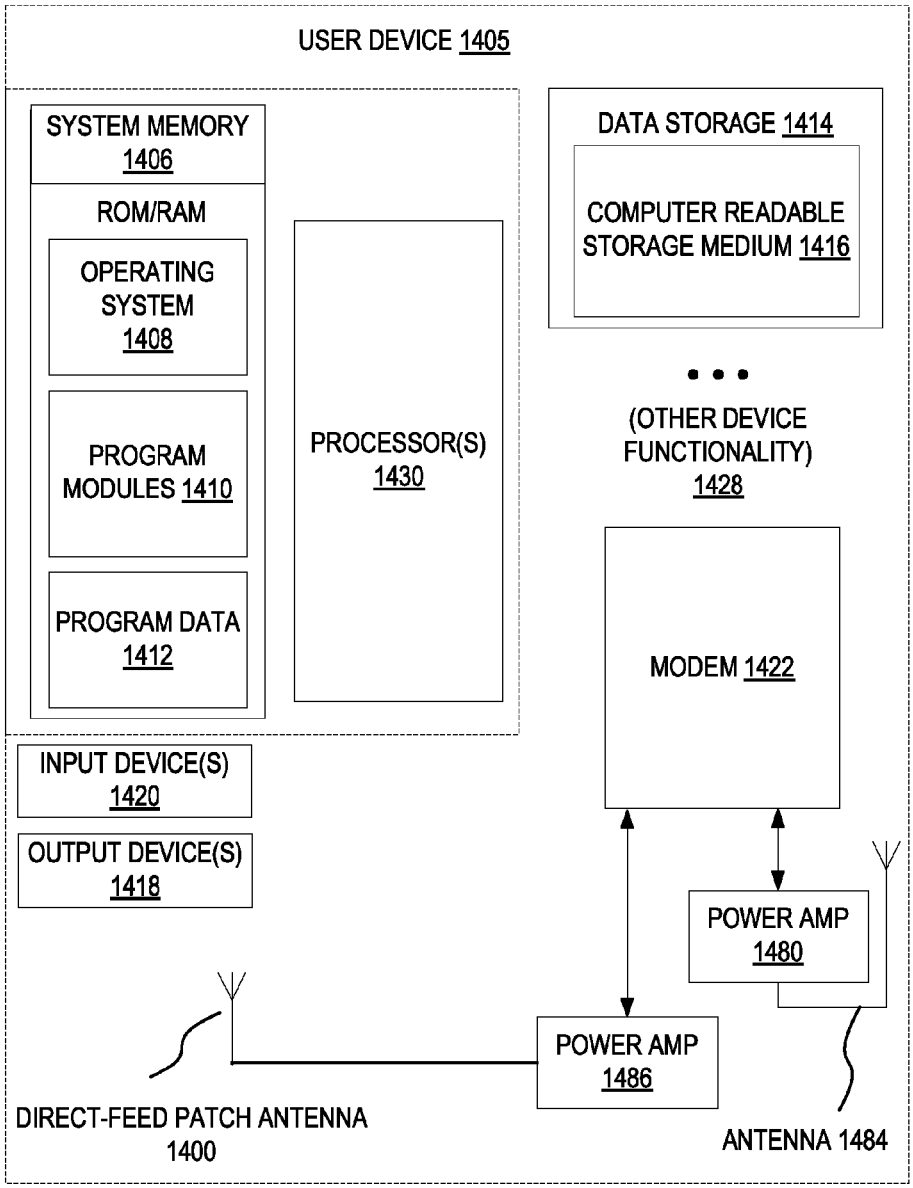
FIG. 14 is a block diagram of a user device having a direct-feed patch antenna according to one embodiment.

FIG. 14 is a block diagram of a user device 1405 having a direct-feed patch antenna 1400 according to one embodiment. The user device 1405 includes one or more processors 1430, such as one or more CPUs, microcontrollers, field programmable gate arrays, or other types of processing devices. The user device 1405 also includes system memory 1406, which may correspond to any combination of volatile and/or non-volatile storage mechanisms. The system memory 1406 stores information that provides an operating system component 1408, various program modules 1410, program data 1412, and/or other components. The user device 1405 performs functions by using the processor(s) 1430 to execute instructions provided by the system memory 1406.

The user device 1405 also includes a data storage device 1414 that may be composed of one or more types of removable storage and/or one or more types of non-removable storage. The data storage device 1414 includes a computer-readable storage medium 1416 on which is stored one or more sets of instructions embodying any one or more of the functions of the user device 1405, as described herein. As shown, instructions may reside, completely or at least partially, within the computer readable storage medium 1416, system memory 1406 and/or within the processor(s) 1430 during execution thereof by the user device 1405, the system memory 1406, and the processor(s) 1430 constituting computer-readable media. The user device 1405 may also include one or more input devices 1420 (keyboard, mouse device, specialized selection keys, etc.) and one or more output devices 1418 (displays, printers, audio output mechanisms, etc.).

The user device 1405 further includes a wireless modem 1422 to allow the user device 1405 to communicate via a wireless network (e.g., such as provided by a wireless communication system) with other computing devices, such as remote computers, an item providing system, and so forth. The wireless modem 1422 allows the user device 1405 to handle both voice and non-voice communications (such as communications for text messages, multimedia messages, media downloads, web browsing, etc.) with a wireless communication system. The wireless modem 1422 may provide network connectivity using any type of digital mobile network technology including, for example, cellular digital packet data (CDPD), general packet radio service (GPRS), enhanced data rates for GSM evolution (EDGE), UMTS, 1 times radio transmission technology (1xRTT), evaluation data optimized (EVDO), high-speed downlink packet access (HSDPA), WiFi, etc. In other embodiments, the wireless modem 1422 may communicate according to different communication types (e.g., WCDMA, GSM, LTE, CDMA, WiMax, etc) in different cellular networks. The cellular network architecture may include multiple cells, where each cell includes a base station configured to communicate with user devices within the cell. These cells may communicate with the user devices 1405 using the same frequency, different frequencies, same communication type (e.g., WCDMA, GSM, LTE, CDMA, WiMax, etc), or different communication types. Each of the base stations may be connected to a private, a public network, or both, such as the Internet, a local area network (LAN), a public switched telephone network (PSTN), or the like, to allow the user devices 1405 to communicate with other devices, such as other user devices, server computing systems, telephone devices, or the like. In addition to wirelessly connecting to a wireless communication system, the user device 1405 may also wirelessly connect with other user devices. For example, user device 1405 may form a wireless ad hoc (peer-to-peer) network with another user device.

The wireless modem 1422 may generate signals and send these signals to power amplifier (amp) 1480 or power amp 1486 for amplification, after which they are wirelessly transmitted via the direct-feed patch antenna 1400 or antenna 1484, respectively. The direct-feed patch antenna 1400 may be any one of the direct-feed patch antennas described herein, including, but not limited to direct-feed patch antennas 100, 300, 500, 700, 900, and 1100. Although FIG. 14 illustrates power amps 1480 and 1486, in other embodiments, a transceiver may be used to all the antennas 1400 and 1484 to transmit and receive. The antenna 1484, which is an optional antenna that is separate from the direct-feed patch antenna 1400, may be any directional, omnidirectional, or non-directional antenna in a different frequency band than the frequency bands of the direct-feed patch antenna 1400. The antenna 1484 may also transmit information using different wireless communication protocols than the direct-feed patch antenna 1400. In addition to sending data, the direct-feed patch antenna 1400 and the antenna 1484 also receive data, which is sent to wireless modem 1422 and transferred to processor(s) 1430. It should be noted that, in other embodiments, the user device 1405 may include more or less components as illustrated in the block diagram of FIG. 14.

In one embodiment, the user device 1405 establishes a first connection using a first wireless communication protocol, and a second connection using a different wireless communication protocol. The first wireless connection and second wireless connection may be active concurrently, for example, if a user device is downloading a media item from a server (e.g., via the first connection) and transferring a file to another user device (e.g., via the second connection) at the same time. Alternatively, the two connections may be active concurrently during a handoff between wireless connections to maintain an active session (e.g., for a telephone conversation). Such a handoff may be performed, for example, between a connection to a WiFi hotspot and a connection to a wireless carrier system. In one embodiment, the first wireless connection is associated with a first resonant mode of the direct-feed patch antenna 1400 that operates at a first frequency band and the second wireless connection is associated with a second resonant mode of the direct-feed patch antenna 1400 that operates at a second frequency band. In another embodiment, the first wireless connection is associated with the direct-feed patch antenna 1400 and the second wireless connection is associated with the antenna 1484. In other embodiments, the first wireless connection may be associated with a media purchase application (e.g., for downloading electronic books), while the second wireless connection may be associated with a wireless ad hoc network application. Other applications that may be associated with one of the wireless connections include, for example, a game, a telephony application, an Internet browsing application, a file transfer application, a global positioning system (GPS) application, and so forth.

Though a single modem 1422 is shown to control transmission to both antennas 1400 and 1484, the user device 1405 may alternatively include multiple wireless modems, each of which is configured to transmit/receive data via a different antenna and/or wireless transmission protocol. In addition, the user device 1405, while illustrated with two antennas 1400 and 1484, may include more or fewer antennas in various embodiments.

The user device 1405 delivers and/or receives items, upgrades, and/or other information via the network. For example, the user device 1405 may download or receive items from an item providing system. The item providing system receives various requests, instructions, and other data from the user device 1405 via the network. The item providing system may include one or more machines (e.g., one or more server computer systems, routers, gateways, etc.) that have processing and storage capabilities to provide the above functionality. Communication between the item providing system and the user device 1405 may be enabled via any communication infrastructure. One example of such an infrastructure includes a combination of a wide area network (WAN) and wireless infrastructure, which allows a user to use the user device 1405 to purchase items and consume items without being tethered to the item providing system via hardwired links. The wireless infrastructure may be provided by one or multiple wireless communications systems, such as one or more wireless communications systems. One of the wireless communication systems may be a wireless fidelity (WiFi) hotspot connected with the network. Another of the wireless communication systems may be a wireless carrier system that can be implemented using various data processing equipment, communication towers, etc. Alternatively, or in addition, the wireless carrier system may rely on satellite technology to exchange information with the user device 1405.

The communication infrastructure may also include a communication-enabling system that serves as an intermediary in passing information between the item providing system and the wireless communication system. The communication-enabling system may communicate with the wireless communication system (e.g., a wireless carrier) via a dedicated channel, and may communicate with the item providing system via a non-dedicated communication mechanism, e.g., a public Wide Area Network (WAN) such as the Internet.

The user devices 1405 are variously configured with different functionality to enable consumption of one or more types of media items. The media items may be any type of format of digital content, including, for example, electronic texts (e.g., eBooks, electronic magazines, digital newspapers, etc.), digital audio (e.g., music, audible books, etc.), digital video (e.g., movies, television, short clips, etc.), images (e.g., art, photographs, etc.), and multi-media content. The user devices 1405 may include any type of content rendering devices such as electronic book readers, portable digital assistants, mobile phones, laptop computers, portable media players, tablet computers, cameras, video cameras, netbooks, notebooks, desktop computers, gaming consoles, DVD players, media centers, and the like.

Figure 15:
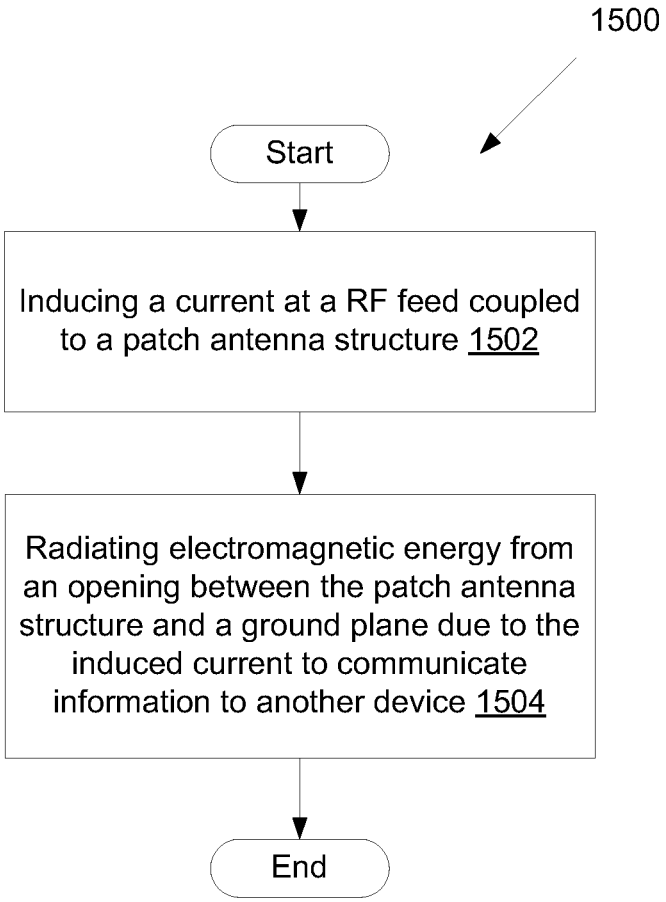
FIG. 15 is a flow diagram of an embodiment of a method of operating a user device having a direct-feed patch antenna according to one embodiment.

FIG. 15 is a flow diagram of an embodiment of a method 1500 of operating a user device having a direct-feed patch antenna according to one embodiment. In method 1500, a current is induced at an RF feed coupled to a patch antenna structure (e.g., patch antenna element 120) to provide multiple resonant modes (block 1502). In response, the patch antenna structure radiates electromagnetic energy to communicate information to another device (block 1504). The electromagnetic energy forms a radiation pattern. The radiation pattern may be various shapes as would be appreciated by one of ordinary skill in the art having the benefit of this disclosure.

In one embodiment, a current is induced at the RF feed, which induces a surface current flow of the patch antenna. The opening (e.g., opening 128) between the patch antenna and the ground plane radiate electromagnetic energy at multiple frequency ranges as described herein.

In the above description, numerous details are set forth. It will be apparent, however, to one of ordinary skill in the art having the benefit of this disclosure, that embodiments of the present invention may be practiced without these specific details. In some instances, well-known structures and devices are shown in block diagram form, rather than in detail, in order to avoid obscuring the description.

Some portions of the detailed description are presented in terms of algorithms and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise as apparent from the above discussion, it is appreciated that throughout the description, discussions utilizing terms such as "inducing," "parasitically inducing," "radiating," "detecting," determining," "generating," "communicating," "receiving," "disabling," or the like, refer to the actions and processes of a computer system, or similar electronic computing device, that manipulates and transforms data represented as physical (e.g., electronic) quantities within the computer system's registers and memories into other data similarly represented as physical quantities within the computer system memories or registers or other such information storage, transmission or display devices.

Embodiments of the present invention also relate to an apparatus for performing the operations herein. This apparatus may be specially constructed for the required purposes, or it may comprise a general-purpose computer selectively activated or reconfigured by a computer program stored in the computer. Such a computer program may be stored in a computer readable storage medium, such as, but not limited to, any type of disk including floppy disks, optical disks, CD-ROMs, and magnetic-optical disks, read-only memories (ROMs), random access memories (RAMs), EPROMs, EEPROMs, magnetic or optical cards, or any type of media suitable for storing electronic instructions.

The algorithms and displays presented herein are not inherently related to any particular computer or other apparatus. Various general-purpose systems may be used with programs in accordance with the teachings herein, or it may prove convenient to construct a more specialized apparatus to perform the required method steps. The required structure for a variety of these systems will appear from the description below. In addition, the present invention is not described with reference to any particular programming language. It will be appreciated that a variety of programming languages may be used to implement the teachings of the present invention as described herein. It should also be noted that the terms "when" or the phrase "in response to," as used herein, should be understood to indicate that there may be intervening time, intervening events, or both before the identified operation is performed.

It is to be understood that the above description is intended to be illustrative, and not restrictive. Many other embodiments will be apparent to those of skill in the art upon reading and understanding the above description. The scope of the present invention should, therefore, be determined with reference to the appended claims, along with the full scope of equivalents to which such claims are entitled.

What is claimed is:

1. A user device comprising:

a single radio frequency (RF) input; and a direct-feed patch antenna coupled to the single RF input, wherein the direct-feed patch antenna comprises:

a ground plane disposed in a first plane of the user device;

a patch element formed of at least a portion of a metal member of the user device, the patch element disposed in a second plane of the user device;

a direct feed coupled to the single RF input, wherein the direct feed is disposed at a feed location at the metal member; and a stub coupled to the ground plane, wherein the stub is disposed at a grounding location disposed in relation to the feed location, and wherein the patch element is configured to radiate at an opening between the patch element and the ground plane, wherein the metal member comprises a polygon shape, and wherein the feed location and the grounding location are disposed on a first side of the polygon shape.

2. The user device of claim 1, wherein the grounding location and the feed location are disposed on the first side of the metal member.

3. The user device of claim 1, wherein the grounding location and the feed location are disposed at an edge of the metal member.

4. The user device of claim 1, wherein the grounding location and the feed location are disposed on the metal member to correspond to a top edge of a circuit board disposed between the patch element and the ground plane.

5. The user device of claim 1 wherein the metal member comprises three sides, including the first side, and wherein the grounding location and the feed location are disposed at the first side at the opening between the patch element and the ground plane.

6. The user device of claim 1, wherein the metal member comprises a plurality of sides, including the first side, and wherein the first side is at a top side of the user device, and wherein the grounding location and the feed location are disposed at the top side.

7. The user device of claim 1, wherein the metal member comprises an organic shape.

8. The user device of claim 1, wherein the direct-feed patch antenna is configured to operate as a global positioning system (GPS) antenna.

9. The user device of claim 1, wherein the direct-feed patch antenna is configured to operate as a wireless local area network (WLAN) antenna.

10. The user device of claim 1, wherein the metal member is a structural member of the user device, and wherein the structural member is at least one of a first metallic support member that supports a circuit board of the user device, a second metallic support member that supports a display of the user device, a third metallic support member that supports a user input device, a metal back panel of an assembly that supports the circuit board, a metallic housing of the user device, a metal portion of a non-metallic housing of the user device, or a metallic bezel of the user device.

11. The user device of claim 1, wherein the direct-feed patch antenna is configured to provide a single resonant mode.

12. The user device of claim 11, wherein the single resonant mode corresponds to one or more portions of a global positioning system (GPS) frequency band.

13. The user device of claim 1, wherein the direct-feed patch antenna is configured to provide a first resonant mode and a second resonant mode.

14. The user device of claim 13, wherein the first resonant mode corresponds to one or more portions of a first Wi-Fi frequency band and the second resonant mode corresponds to one or more portions of a second Wi-Fi frequency band.

15. A user device comprising:

a single radio frequency (RF) input; and a direct-feed patch antenna coupled to the single RF input, wherein the direct-feed patch antenna comprises:

a ground plane disposed in a first plane of the user device;

a patch element formed of at least a portion of a metal member of the user device, the patch element disposed in a second plane of the user device, wherein the patch element comprises:

a first portion disposed in the second plane, wherein the first portion comprises a triangular shape;

a second portion disposed in a third plane perpendicular to the first and second planes; and a third portion disposed in a fourth plane perpendicular to the first and second planes and orthogonal to the third plane;

a direct feed coupled to the single RF input; and a stub coupled to the ground plane, and wherein the patch element is configured to radiate at an opening between the patch element and the ground plane.

16. The user device of claim 15, wherein the direct feed is disposed at a feed location of the patch element and the stub is coupled to the ground plane at a grounding location, wherein the feed location and the grounding location are disposed at an edge of the first portion of the patch element, and wherein the second portion and the third portion are not directly coupled to the ground plane.

17. An apparatus comprising a direct-feed patch antenna formed of a metal member of the apparatus disposed in relation to a ground plane, wherein the direct-feed patch antenna is grounded to the ground plane at a grounding location disposed in relation to a feed location of the direct-feed patch antenna, the feed location to be directly coupled to receive a radio frequency (RF) signal, wherein the direct-feed patch antenna is configured to radiate electromagnetic energy in response to the RF signal, wherein the direct-feed patch antenna comprises:

a first portion disposed in a second plane;

a second portion disposed in a third plane perpendicular to the ground plane and the second plane; and a third portion disposed in a fourth plane perpendicular to the ground plane and the second plane and orthogonal to the third plane.

18. The apparatus of claim 17, further comprising a grounding stub coupled between the grounding location and the ground plane.

19. The apparatus of claim 17, further comprising a single RF input directly coupled to the feed location.

20. The apparatus of claim 17, wherein the grounding location and the feed location are disposed on a first side of the metal member.

21. The apparatus of claim 17, wherein the grounding location and the feed location are disposed at an edge of the metal member.

22. The apparatus of claim 17, wherein the grounding location and the feed location are disposed on the metal member to correspond to a top edge of a circuit board disposed between the metal member and the ground plane.

23. The apparatus of claim 17, wherein the metal member is a structural member of the apparatus, and wherein the structural member is at least one of a first metallic support member that supports a circuit board of the apparatus, a second metallic support member that supports a display of the apparatus, a third metallic support member that supports a user input device, a metal back panel of an assembly that supports the circuit board, a metallic housing of the apparatus, a metal portion of a non-metallic housing of the apparatus, or a metallic bezel of the apparatus.

24. The apparatus of claim 17, wherein the direct-feed patch antenna is configured to provide a plurality of resonant modes.

25. A user device comprising:

a wireless modem; and a direct-feed patch antenna coupled to the wireless modem and a ground plane disposed in a first plane of the user device, wherein the direct-feed patch antenna is formed of a metal member in a second plane of the user device, wherein the direct-feed patch antenna is grounded to the ground plane at a grounding location disposed in relation to a feed location of the direct-feed patch antenna, the feed location to be directly coupled to receive a radio frequency (RF) signal, and wherein the direct-feed patch antenna is configured to radiate electromagnetic energy in response to the RF signal, wherein the metal member comprises:

a first portion disposed in the second plane;

a second portion disposed in a third plane perpendicular to the ground plane and the second plane; and a third portion disposed in a fourth plane perpendicular to the ground plane and the second plane and orthogonal to the third plane.

26. The user device of claim 25, further comprising a transceiver coupled to the wireless modem and the feed location.

27. The user device of claim 25, wherein the direct-feed patch antenna is configured to operate in a global positioning system (GPS).

28. The user device of claim 25, wherein the direct-feed patch antenna is configured to operate in a wireless local area network (WLAN) antenna.

* * * * *